US009975152B1

(12) United States Patent
McClarren

(10) Patent No.: US 9,975,152 B1
(45) Date of Patent: May 22, 2018

(54) AIR CONDITIONER CONDENSATE DRAIN LINE CLEAN-OUT SYSTEM

(71) Applicant: Steven M. McClarren, North Port, FL (US)

(72) Inventor: Steven M. McClarren, North Port, FL (US)

( * ) Notice: Subject to any disclaimer, the term of this patent is extended or adjusted under 35 U.S.C. 154(b) by 0 days. days.

(21) Appl. No.: 15/413,922

(22) Filed: Jan. 24, 2017

(51) Int. Cl.
*B08B 9/032* (2006.01)
*F24F 13/22* (2006.01)

(52) U.S. Cl.
CPC ..... *B08B 9/0325* (2013.01); *F24F 13/222* (2013.01); *F24F 2013/227* (2013.01); *F24F 2221/22* (2013.01); *Y10T 137/4259* (2015.04); *Y10T 137/4372* (2015.04)

(58) Field of Classification Search
CPC ..... B08B 8/027; B08B 9/0325; F24F 13/222; F24F 222/22; F24F 2221/225; F24F 2013/228; F24F 2013/227; F25D 21/14; F28G 9/00; Y10T 137/4259; Y10T 137/4372
USPC ..... 137/240
See application file for complete search history.

(56) References Cited

U.S. PATENT DOCUMENTS 4,937,559 A * 6/1990 Meacham et al. ..... F24F 13/22 200/61.04
4,998,412 A * 3/1991 Bell ..... F24F 13/22 134/166 C
5,964,238 A 10/1999 Junkin
6,442,956 B1 * 9/2002 Herren ..... F24F 13/222 62/150
6,708,717 B1 3/2004 Coogle
7,364,053 B2 * 4/2008 Ophardt ..... A47K 5/16 137/801
7,392,658 B1 7/2008 Hardy, III
8,475,603 B2 7/2013 Kaiser
8,535,453 B1 9/2013 Gonzalez
8,646,474 B2 2/2014 Pearson
8,840,729 B1 9/2014 Herren et al.

* cited by examiner

*Primary Examiner* — Kevin Lee
(74) *Attorney, Agent, or Firm* — Livingston Loeffler, P.A.; Edward M. Livingston, Esq.; Bryan L. Loeffler, Esq.

(57) ABSTRACT

An automatic air conditioner condensate drain line clean-out system (1) having a flushing line (6) which is preferably supplied by a home's hot water heater and connected to a condensate drain line (3). A supply valve (10) that supplies the hot water preferably controlled by a timer (11) that allows the system to be activated on a reoccurring basis. A drain valve (13) is located on the condensate drain line subsequent to a point of connection between the flushing line and the condensate drain line to prevent backflow of water from the flushing line into a drain pan (2) of the air conditioning system.

12 Claims, 2 Drawing Sheets

AIR CONDITIONER CONDENSATE DRAIN LINE CLEAN-OUT SYSTEM

FIELD OF THE INVENTION

The present invention relates to air conditioning systems and more particularly an air conditioning condensate drain line clean-out system that automatically cleans the drain line on a reoccurring basis to prevent blockages from occurring within the drain line.

BACKGROUND OF THE INVENTION

One of the most common problems that a user of an air conditioning system faces is that of clogged condensate drain lines and overflowing drain pans which cause untold damage annually due to water flooding of structures. Typically, when this occurs, the owner or user of the air conditioning system must call a repairman to remove the blockage by disassembling the drain line and injecting compressed air into the line to remove the blockage. This may occur numerous times during the life of the air conditioning system and result in a costly expense for the consumer for the service call and repair. When left undetected, blockages in the drain line can cause water collected in a drain pan to overflow and damage walls, flooring and furniture.

Blockages are commonly caused by dust and debris from the drain pan that finds its way into the drain line and/or mold, algae and so forth growing in the drain line. These blockages can easily be prevented with routine cleaning of the drain line.

Therefore, a need exists for an air conditioning condensate drain line clean-out system that automatically cleans the drain line on a reoccurring basis to prevent blockages from occurring within the drain line.

The relevant prior art includes the following references:

| Pat. No. | Inventor | Issue/Publication Date |
|---|---|---|
| (U.S. Pat. References) | | |
| 5,964,238 | Junkin | Oct. 12, 1999 |
| 7,392,658 | Hardy, III | Jul. 1, 2008 |
| 8,475,603 | Kaiser | Jul. 2, 2013 |
| 8,535,453 | Gonzalez | Sep. 17, 2013 |
| 8,646,474 | Pearson | Feb. 11, 2014 |
| 6,708,717 | Coogle | Mar. 23, 2004 |
| 8,840,729 | Herren et al. | Sep. 23, 2014 |

SUMMARY OF THE INVENTION

The primary object of the present invention is to provide an air conditioning condensate drain line clean-out system that automatically cleans the drain line on a reoccurring basis to prevent blockages from occurring within the drain line.

The present invention fulfills the above and other objects by providing an automatic air conditioner condensate drain line clean-out system having a flushing line connected to a condensate drain line and supplied water by a home's hot water heater. A supply valve that controls the flow of hot water into the flushing line is preferably controlled by a timer that is powered by a 12 volt transformer. The timer allows the system to be activated on a reoccurring basis. A drain valve is located on the condensate drain line subsequent to a point of connection between the flushing line and the condensate drain line to prevent backflow of water from the flushing line into the drain pan of the air conditioning system.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
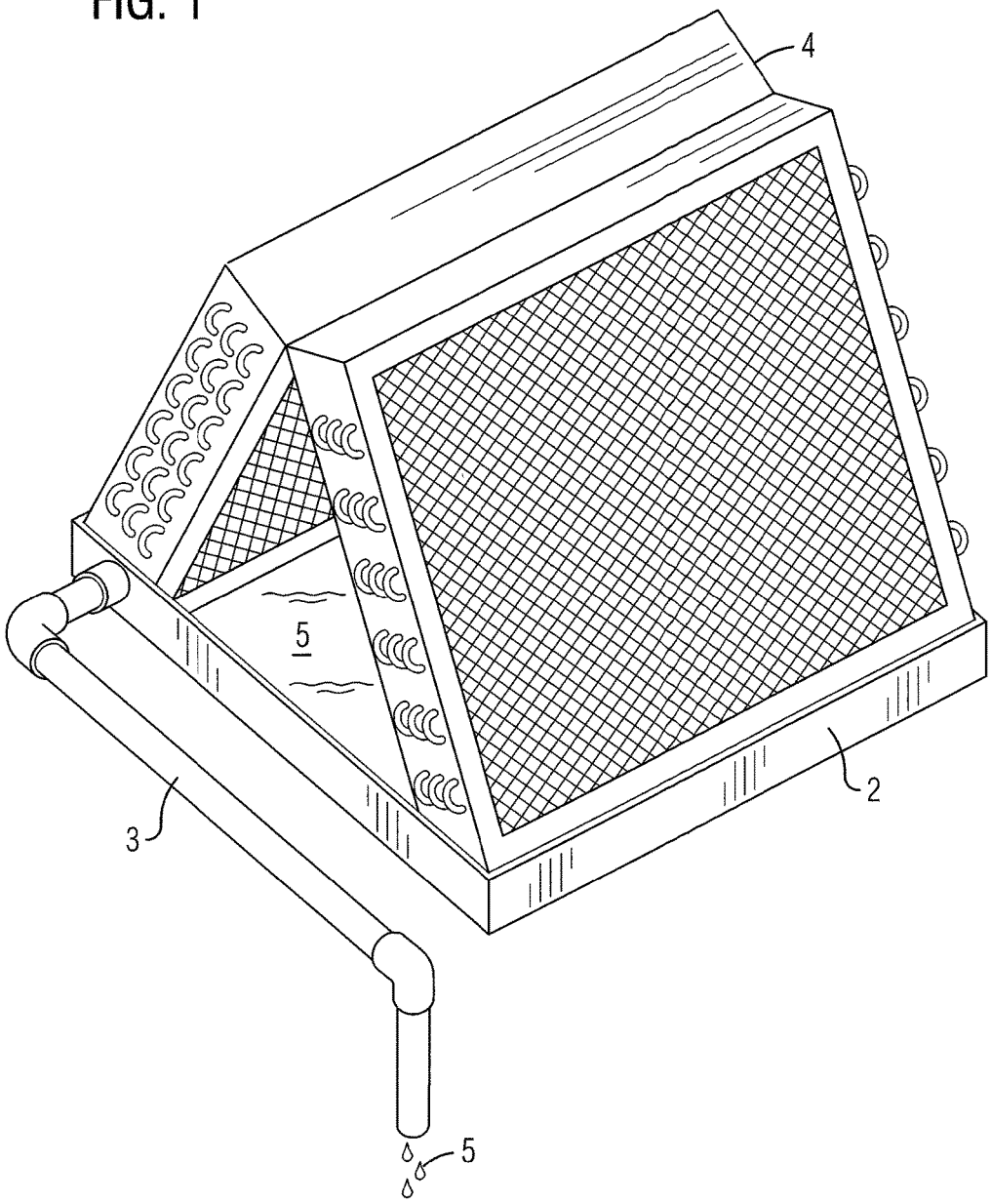
FIG. 1 is a perspective view of a conventional air conditioning drain pan and condensate drain line.

For purposes of describing the preferred embodiment, the terminology used in reference to the numbered accessories in the drawings is as follows:

1. air conditioning condensate drain line clean-out system, generally
2. drain pan
3. drain line
4. condenser
5. condensate
6. flushing line
7. water source
8. hot water heater
9. supply line
10. supply valve
11. timer
12. open end of drain line
13. drain valve
14. transformer
15. perpendicular section
16. cross-section With general reference to FIG. 1, a perspective view of a conventional air conditioning drain pan 2 and condensate drain line 3 is illustrated. Conventional air conditioning systems comprise a condenser 4 mounted over a drain pan 2 that collects condensate 5 that drips from the condenser 4. Condensate 5 collected in the drain pan 2 is directed toward a condensate drain line 3, which directs the condensate 5 to a sewer drain or outside of the structure in which the air conditioning system is installed. When the condensate drain line 3 becomes clogged with debris, the condensate 5 is unable to drain from the drain pan 2 and thus, collects in the drain pan 2 until the condensate 5 over flows and pours downward into the structure in which the air conditioning system is installed causing damage thereto.

Figure 2:
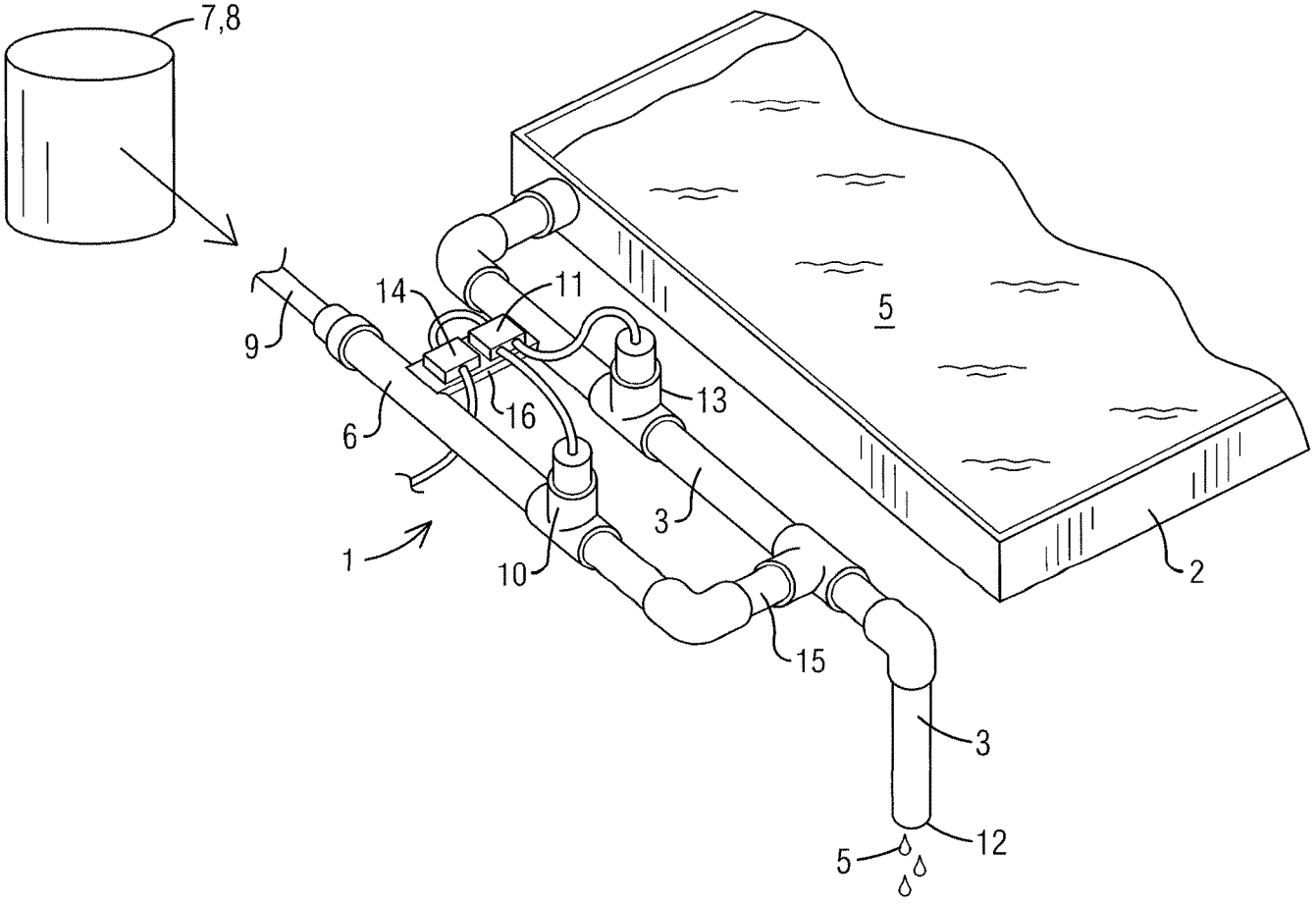
FIG. 2 is a perspective view of a conventional air conditioning drain pan and condensate drain line having an air conditioning condensate drain line clean-out system of the present invention incorporated therein.

With general reference to FIG. 2, a perspective view of a conventional air conditioning drain pan 2 and condensate drain line 3 having an air conditioning condensate drain line clean-out system 1 of the present invention incorporated therein is illustrated. The air conditioner condensate drain line clean-out system 1 of the present invention may be integrated into a new air conditioning system or installed on an existing air conditioning system on the condensate drain line 3 thereof. The air conditioner condensate drain line clean-out system 1 comprises a flushing line 6 connected to a water source 7, such as a hot water heater 8, either directly or through a structure's plumbing system via a supply line 9 connected to the water source 7. A supply valve 10 allows preferably hot water to enter the condensate drain line 3 when the supply valve 10 is opened via a timer 11. As water enters the condensate drain line 3, the water travels in two directions, toward the drain pan 2 of the air conditioning system and toward an open end 12 of the condensate drain line 3 through which condensate 5 normally drains from. A drain valve 13 is located on the condensate drain line 3 subsequent to a point of connection between the flushing line 6 and the condensate drain line 3 to prevent backflow of water from the flushing line 6 into the drain pan 2 of the air conditioning system. The supply valve 10 and the drain valve 13 are controlled by a timer 11 that opens and closes the supply valve 10 and the drain valve 13 simultaneously so that when the supply valve 10 is opened, the drain valve 13 is closed and when the supply valve 10 is closed, the drain valve 13 is opened. The timer 11 is preferably supplied power via a 12 volt transformer 14. The timer 11 is preferably programmed to open and close the supply valve 10 and the drain valve 13 on a reoccurring basis to clean out the condensate drain line 3 prior to any blockages occurring.

As illustrated herein, the condensate drain line 3 and flushing line 6 are in parallel positions connected by at least one perpendicular section 15 of the flushing line 6 and at least one cross-member 16, thereby creating a rectangular-shaped configuration between the condensate drain line 3 and flushing line 6. This configuration allows the system 1 to be installed in a confined area while providing support for the flushing line 6 to prevent loosening of any connections over time, which could result in flooding.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An air conditioning condensate drain line clean-out system comprising:

a flushing line connected to a water source and to a condensate drain line;

a supply valve located on the flushing line;

a drain valve located on the condensate drain line between a drain pan and a point of connection between the flushing line and the condensate drain line;

a timer connected to the supply valve and the drain valve that opens and closes the supply valve and the drain valve simultaneously so that when the supply valve is opened, the drain valve is closed; and said condensate drain line and flushing line are in parallel positions connected by at least one perpendicular section of the flushing line and at least one cross-member to create a rectangular-shaped configuration between the condensate drain line and the flushing line.

2. The air conditioning condensate drain line clean-out system of claim 1 wherein:

said timer is supplied power via a 12 volt transformer.

3. The air conditioning condensate drain line clean-out system of claim 1 wherein:

said timer is programmed to open and close the supply valve and the drain valve on a reoccurring basis to clean out the condensate drain line prior to any blockages occurring within the condensate drain line.

4. The air conditioning condensate drain line clean-out system of claim 1 wherein:

said flushing line is connected to a structure's plumbing system through a supply line.

5. An air conditioning condensate drain line clean-out system comprising:

a flushing line connected to a water source and to a condensate drain line;

a supply valve located on the flushing line;

a drain valve located on the condensate drain line between a drain pan and a point of connection between the flushing line and the condensate drain line;

a timer connected to the supply valve and the drain valve that opens and closes the supply valve and the drain valve simultaneously so that when the supply valve is opened, the drain valve is closed; and wherein an elongated portion of said condensate drain line and an elongated portion of said flushing line are in parallel positions connected by at least one perpendicular section of the flushing line and at least one cross-member to create a rectangular-shaped configuration between the condensate drain line and the flushing line.

6. The air conditioning condensate drain line clean-out system of claim 5 wherein:

said timer is supplied power via a 12 volt transformer.

7. The air conditioning condensate drain line clean-out system of claim 5 wherein:

said timer is programmed to open and close the supply valve and the drain valve on a reoccurring basis to clean out the condensate drain line prior to any blockages occurring within the condensate drain line.

8. The air conditioning condensate drain line clean-out system of claim 5 wherein:

said flushing line is connected to a structure's plumbing system through a supply line.

9. An air conditioning condensate drain line clean-out system comprising:

a flushing line connected to a water source and to a condensate drain line;

a supply valve located on the flushing line;

a drain valve located on the condensate drain line between a drain pan and a point of connection between the flushing line and the condensate drain line;

a timer connected to the supply valve and the drain valve that opens and closes the supply valve and the drain valve simultaneously so that when the supply valve is opened, the drain valve is closed;

wherein an elongated portion of said condensate drain line and an elongated portion of said flushing line are in parallel positions connected by at least one perpendicular section of the flushing line and at least one cross-member to create a rectangular-shaped configuration between the condensate drain line and the flushing line;

said supply valve being located on the elongated portion of said flushing line; and a drain valve being located on the elongated portion of said condensate drain line.

10. The air conditioning condensate drain line clean-out system of claim 9 wherein:

said timer is supplied power via a 12 volt transformer.

11. The air conditioning condensate drain line clean-out system of claim 9 wherein:

said timer is programmed to open and close the supply valve and the drain valve on a reoccurring basis to clean out the condensate drain line prior to any blockages occurring within the condensate drain line.

12. The air conditioning condensate drain line clean-out system of claim 9 wherein:

said flushing line is connected to a structure's plumbing system through a supply line.

* * * * *